US007197998B1

(12) United States Patent
Rice

(10) Patent No.: US 7,197,998 B1
(45) Date of Patent: Apr. 3, 2007

(54) APPARATUS FOR SUPPORTING AND PULLING A TOW ROPE

(76) Inventor: Darin B. Rice, 9330 Moore Rd., Pleasant Grove, CA (US) 95688

( * ) Notice: Subject to any disclaimer, the term of this patent is extended or adjusted under 35 U.S.C. 154(b) by 0 days.

(21) Appl. No.: 11/074,112

(22) Filed: Mar. 7, 2005

(51) Int. Cl.
*B63B 21/16* (2006.01)

(52) U.S. Cl. ..... 114/254

(58) Field of Classification Search ..... 114/254
See application file for complete search history.

(56) References Cited

U.S. PATENT DOCUMENTS 3,178,127 A * 4/1965 Andersen ..... 242/390.9
3,215,361 A * 11/1965 Jones, Jr. ..... 114/254
3,809,369 A * 5/1974 Elsing ..... 254/390
3,964,425 A 6/1976 Septor, Sr.
4,098,213 A 7/1978 McGinnis
4,133,496 A 1/1979 Zetah
4,887,777 A 12/1989 Rasmussen
5,238,200 A 8/1993 Ritzenthaler
5,632,219 A 5/1997 Fleming, Jr.
5,732,648 A 3/1998 Aragon
5,762,282 A 6/1998 Wolner
6,474,588 B2 11/2002 Valverde

* cited by examiner

*Primary Examiner*—Stephen Avila
(74) *Attorney, Agent, or Firm*—Thomas R. Lampe

(57) ABSTRACT

Tow rope rewinder apparatus includes a spool driven by an electric motor. The motor becomes deenergized after tension of the tow rope reaches a predetermined magnitude.

12 Claims, 4 Drawing Sheets

APPARATUS FOR SUPPORTING AND PULLING A TOW ROPE

TECHNICAL FIELD

This invention relates to apparatus for attachment to a boat and employed to support and pull a tow rope, for example a tow rope utilized by water skiers or wake boarders.

BACKGROUND OF THE INVENTION

As will be seen below, the apparatus of the present invention incorporates a tow rope rewind mechanism utilizing an electric motor to rotate a spool to rewind a tow rope. Such feature, in general, is known. The following patents are believed to be representative of the current state of the prior art in this field: U.S. Pat. No. 6,474,588, issued Nov. 5, 2002, U.S. Pat. No. 5,632,219, issued May 27, 1997, U.S. Pat. No. 5,762,282, issued Jun. 9, 1998, U.S. Pat. No. 5,732,648, issued Mar. 31, 1998, U.S. Pat. No. 5,238,200, issued Aug. 24, 1993, U.S. Pat. No. 4,887,777, issued Dec. 19, 1989, U.S. Pat. No. 3,964,425, issued Jun. 22, 1976, U.S. Pat. No. 4,098,213, issued Jul. 4, 1978 and U.S. Pat. No. 4,133,496, issued Jan. 9, 1979.

Typically, rewinding by an electric motor is initiated and stopped by a manually operated switch. This can cause problems. Continued energization of the rewinder motor after a tow rope is completely wound about an associated spool can cause the motor to burn out or some other type of structural failure. Furthermore, if a skier or wakeboarder is at the trailing or distal end of the tow line during the rewinding operation, continued powered rewinding after a skier goes down and does not let go of the tow rope or an object or person in the boat or water is snagged can have serious consequences. High tensional forces developed in the tow rope due to such circumstances can lead to structural failure and damage or personal injury.

DISCLOSURE OF INVENTION

The apparatus of the present invention is for attachment to a boat to support and pull a tow rope.

The apparatus includes a support and a tow rope spool having a tow rope connected thereto, the tow rope spool rotatably mounted on the support and selectively rotatable in either a winding direction to wind the tow rope thereabout or an unwinding direction to unwind the tow rope.

The apparatus incorporates drive structure including an electric motor operatively associated with the spool selectively actuatable to rotate the spool in the winding direction to wind the tow rope about the spool.

Automatic shut-off structure is operatively associated with the drive structure to deactivate the drive structure to terminate rotation of the spool in the rewinding direction responsive to the tow rope attaining a predetermined condition.

More particularly, the predetermined condition is a magnitude of tension of the tow rope, the automatic shut-off structure deactivating the drive structure when the tow rope reaches the magnitude of tension.

The drive structure additionally includes a spool pulley connected to the spool and a drive pulley rotated by the electric motor operatively associated with the spool pulley to rotate the spool pulley and spool upon rotation of the drive pulley by the electric motor.

Also incorporated in the drive structure is a slip clutch.

The automatic shut-off structure includes a thermal breaker switch for sensing heat developed in the apparatus during slippage of the slip clutch and for deenergizing the electric motor in response thereto to deactivate the drive structure.

The apparatus can easily be retrofit to existing boat structure to replace existing tow rope stanchions.

Other features, advantages and objects of the present invention will become apparent with reference to the following description and accompanying drawings.

MODES FOR CARRYING OUT THE INVENTION

Figure 1:
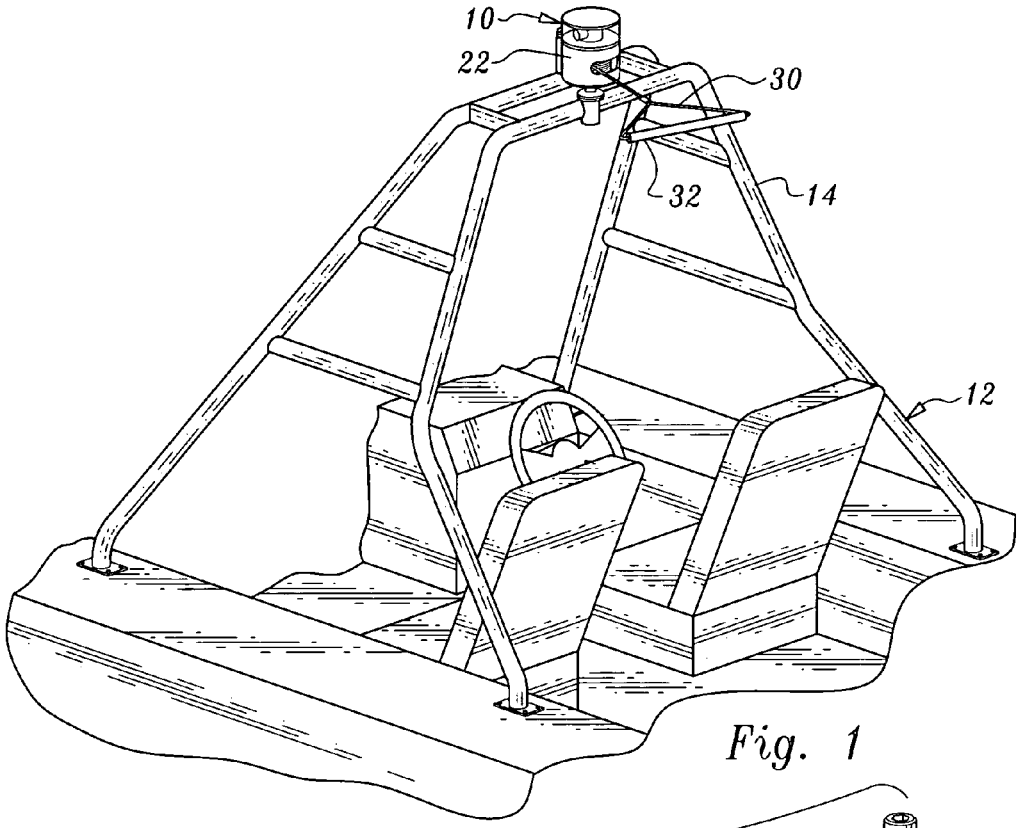
FIG. 1 is a perspective view illustrating a portion of a boat having apparatus constructed in accordance with the teachings of the present invention installed thereon.
Figure 2:
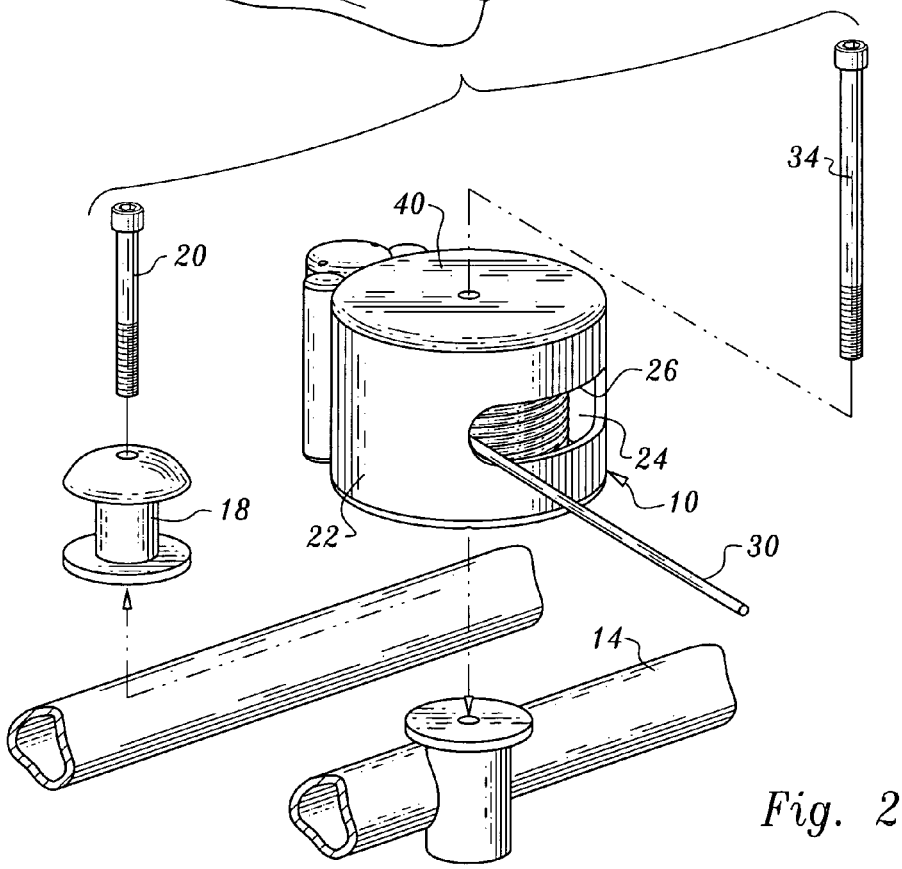
FIG. 2 is an exploded, perspective view illustrating components of the apparatus being retrofitted to structure of the boat to replace a conventional tow rope holder, the latter also being shown.
Figure 4:
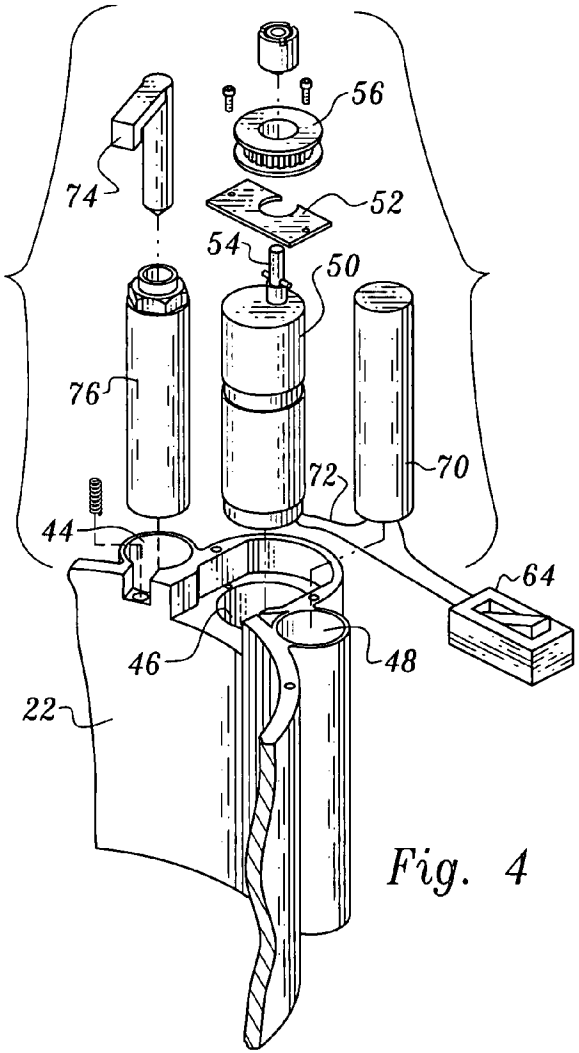
FIG. 4 is a perspective view illustrating a portion of the housing with certain other structural components of the apparatus shown prior to placement in receptacles defined by the housing.
Figure 3:
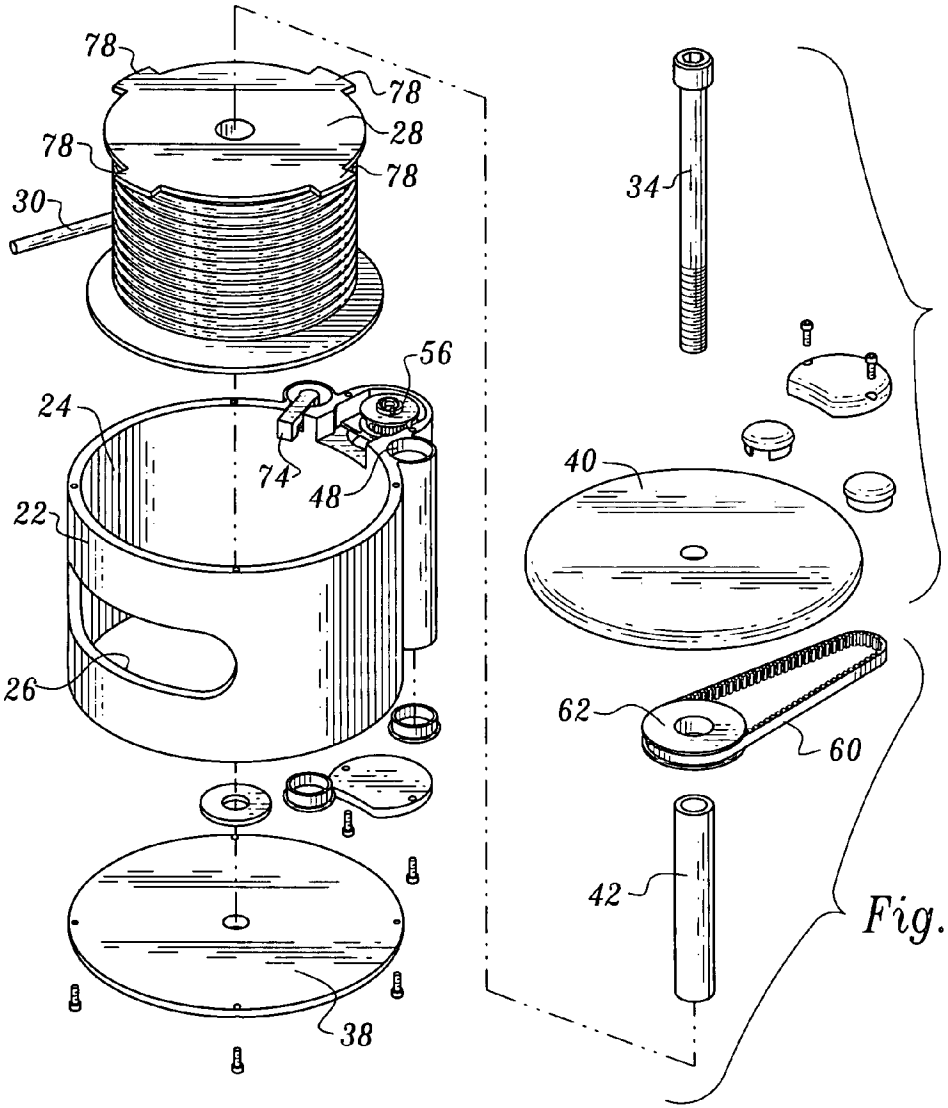
FIG. 3 is an exploded, perspective view of selected components of the apparatus, including a winding spool, a housing for the spool and parts of the apparatus drive structure.

Referring now to FIGS. 1–9 and 13, a preferred embodiment of apparatus constructed in accordance with the teachings of the present invention is illustrated and designated by reference numeral 10. Apparatus 10 is for attachment to a boat to support and pull a tow rope. FIGS. 1 and 2 show portions of a boat 12. Boat 12 includes, as is conventional, a framework or tower 14 allowing the tow rope to be located in an elevated condition. However, it will be appreciated that the apparatus can be attached at any desired location on a boat.

With reference to FIG. 2, details of the framework 14 can be seen. Conventionally, a small stanchion 18 is connected to framework 14 by a threaded bolt 20 and a closed loop (not shown) of a tow rope is placed over and around the stanchion to tow a water skier or wakeboarder. The stanchion does not function as a spool for winding the rope. Applicant's invention, on the other hand, rewinds the rope in a manner which will be discussed in greater detail below. The apparatus is structured so as to be easily retrofit to a mount or frame to replace an attachment stanchion.

Apparatus 10 includes a support incorporating a housing 22 defining a housing interior 24 and a housing opening 26 communicating with the housing interior.

A tow rope spool 28 having a tow rope 30 connected thereto is rotatably mounted on the support within housing interior 24. The tow rope 30 projects outwardly through housing opening 26, the latter being elongated and horizontally disposed, allowing sideways movement of the tow rope during towing. Preferably the opening is large enough to allow manual access to the housing interior and rope therein. As is conventional, a handle 32 is attached to the distal end of the tow rope. The spool 28 is rotatably mounted about a bolt 34 which is threadedly engageable at the lower end thereof projecting downwardly from the housing with framework 14 of the boat 12, more specifically being threadedly engaged with an interiorly threaded central member 36 of the framework to which stanchion 18 was formerly connected. Bolt 34 is longer than stanchion bolt 20 to permit this retrofit.

Housing 22, in the arrangement illustrated, includes a detachable bottom plate 38 and a detachable top plate 40 to facilitate assembly and disassembly of the apparatus. A bushing shaft 42 surrounds bolt 34 and extends between the bottom and top plates. Housing 22 defines receptacles 44, 46 and 48 for containing other components of the apparatus, in the manner to be described below. If desired, the tops and bottoms of the receptacles can be in the form of removable caps or closures, as shown. In FIG. 1, a flashing warning light is disposed on the housing top.

Figure 5:
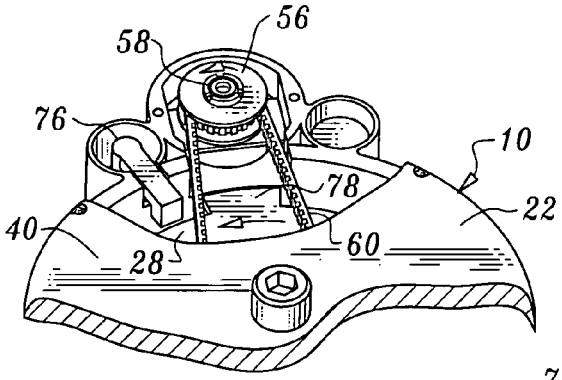
FIG. 5 is a top, perspective view of the apparatus with a housing top plate broken away to show relative positions of certain internal structural components of the apparatus during unwinding of the tow rope.
Figure 6:
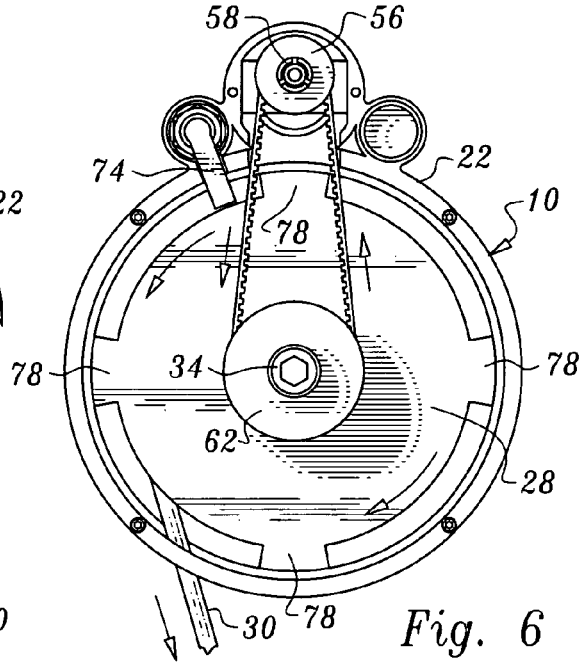
FIG. 6 is a top, plan view of the apparatus with the housing top plate removed showing the internal structural components during unwinding as shown in FIG. 5.
Figure 7:
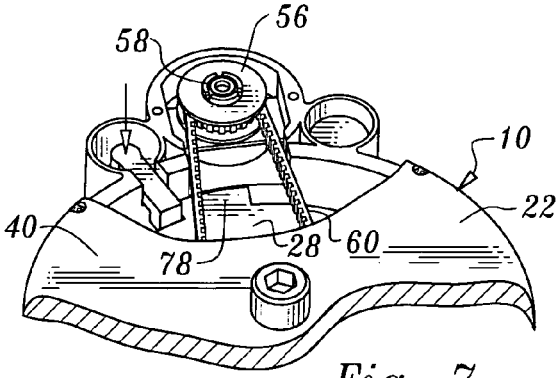
FIG. 7 is a view similar to FIG. 5, but illustrating the apparatus spool locked against rotatable motion.
Figure 8:
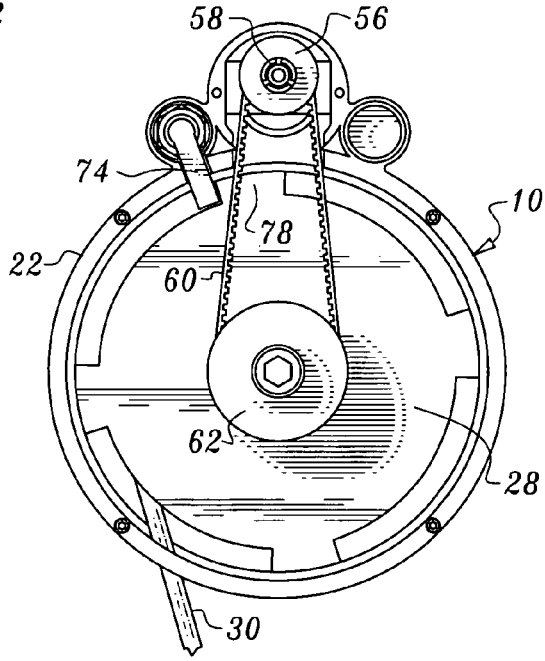
FIG. 8 is a view similar to FIG. 6, showing the spool locked against rotatable motion as depicted in FIG. 7.
Figure 9:
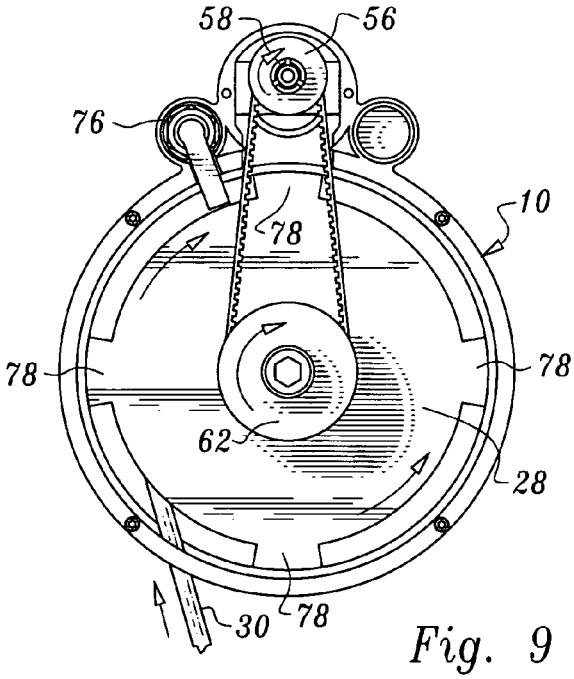
FIG. 9 is a view similar to FIGS. 6 and 8, but illustrating the apparatus rewinding the tow rope, the lock shown disengaged from the spool.

Drive structure is operatively associated with the spool 28 and is selectively actuatable to rotate the spool in a winding direction to wind the tow rope thereabout. The spool may also be rotated in an unwinding direction to unwind the tow rope. FIGS. 5 and 6 show the spool being rotated to unwind the tow rope, FIGS. 7 and 8 show the spool being locked, and FIG. 9 shows the tow rope being rewound, movement being illustrated by arrows.

The drive structure of the device includes an electric gear motor 50 operatively associated with the spool and selectively actuatable to rotate the spool upon energization of the electric motor in the winding direction. The gear motor, as shown, is positioned in receptacle 46 and held in place by a motor mount plate 52 secured by screws. The output shaft 54 of the gear motor projects upwardly through the motor mount plate and is in driving engagement with a geared drive pulley 56 via a slip clutch 58 which may be, for example, high inertia slip device Part Number 43-XXX made available by Reell Precision Manufacturing of St. Paul, Minn. Opposed pins on the output shaft of the gear motor are positioned in opposed slots (not shown) of the slip clutch to provide rotational interconnection.

A timing belt 60 extends between drive pulley 56 and geared spool pulley 62 affixed to spool 28 by any desired expedient. Rotation of the drive pulley 56 as shown by the arrow in FIG. 9 will cause rotation through the timing belt of spool pulley 62 and the spool 28 as shown in FIG. 9. This will result in rewinding of the tow rope. Energization of the gear motor as well as the deenergization thereof are effected manually by a switch 64 (FIG. 13) establishing or interrupting electrical communication with a battery 66.

Automatic shut-off structure is operatively associated with the above-described drive structure to deactivate the drive structure to terminate rotation of the spool 28 in said rewind condition responsive to the tow rope attaining a predetermined condition. More particularly, that predetermined condition is a magnitude of tension of the tow rope, the automatic shut-off structure deactivating the drive structure after the tow rope reaches the magnitude of tension.

The automatic shut-off structure includes a thermal breaker switch 70 which senses heat developed during slippage of the slip clutch, for example in the electrical wiring, and deenergizes the electric motor in response thereto to deactivate the drive structure. In the arrangement illustrated, the thermal breaker switch 70, which may for example be a resettable circuit breaker switch manufactured by NTE and made available as Part No. R59-2A is connected by wire 72 to the gear motor, the thermal breaker switch being in circuit between the on/off switch 64 and the gear motor. Sensors (not shown) of the thermal breaker switch sense heat build-up in the drive structure, for example in the wiring, during slippage of the slip clutch which in turn is caused by the tension of the tow rope reaching a certain magnitude. When the heat build-up is sensed, the thermal breaker switch 70 will break the connection between the gear motor and the battery. This can occur, for example, when the handle 32 engages the housing 22 at the end of the rewind operation. Such tension could also be encountered when a skier or wakeboarder falls and hangs onto the line during rewinding or an object or person in the water or boat is encountered or snagged by the tow line. The thermal breaker switch 70 may be manually reset after the problem is resolved. If desired the flashing warning light may be actuated in response to operation of the thermal breaker switch.

The apparatus includes lock structure for selectively alternatively locking the spool 28 against rotatable movement or unlocking the spool to allow rotation thereof by the drive structure. More particularly, the lock structure includes a solenoid operated lock member or arm 74 projecting upwardly from a solenoid 76. The solenoid is located within receptacle 44 and is selectively energized or deenergized by switch 64. The spool top has projections 78 extending outwardly therefrom which are engageable by the lock member 74 when the lock member moves downwardly relative to the solenoid. FIGS. 7 and 8 illustrate this action which locks the spool against any substantial rotatable movement. In FIGS. 5 and 6, the lock member or arm 74 is raised upwardly, allowing the tow rope to be pulled externally of the housing to unwind it or unwound by the gear motor if of the reversible type. In FIG. 9, the lock member 74 is also raised and not engageable with a projection 78 of the spool to allow rewinding by the motor.

Figure 10:
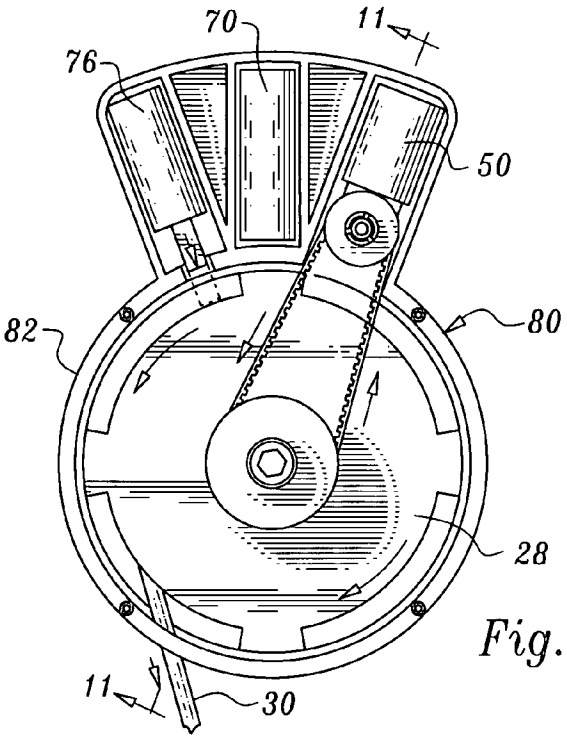
FIG. 10 is a top, plan view similar to FIG. 6, but illustrating an alternative embodiment of the invention.
Figure 11:
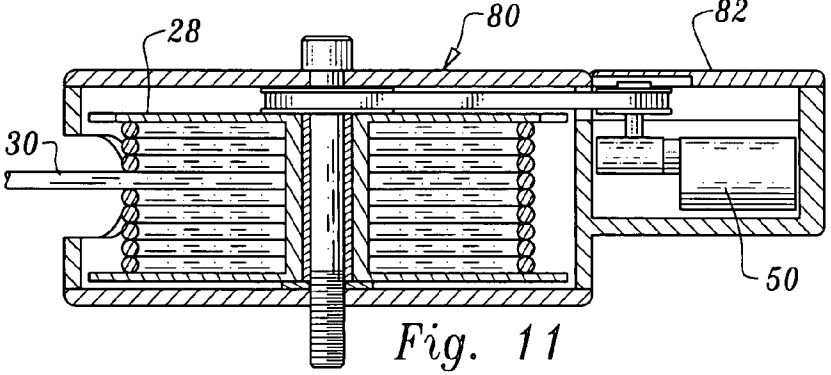
FIG. 11 is an enlarged, cross-sectional view taken along the line 11—11 in FIG. 10.

FIGS. 10 and 11 illustrate another form of the apparatus, identified by reference numeral 80, which is essentially the same as apparatus 10 except that the receptacles defined by housing 82 project outwardly so that the receptacles and the primary axes of the solenoid, gear motor and thermal breaker switch components are oriented side-by-side in a horizontal plane.

Figure 12:
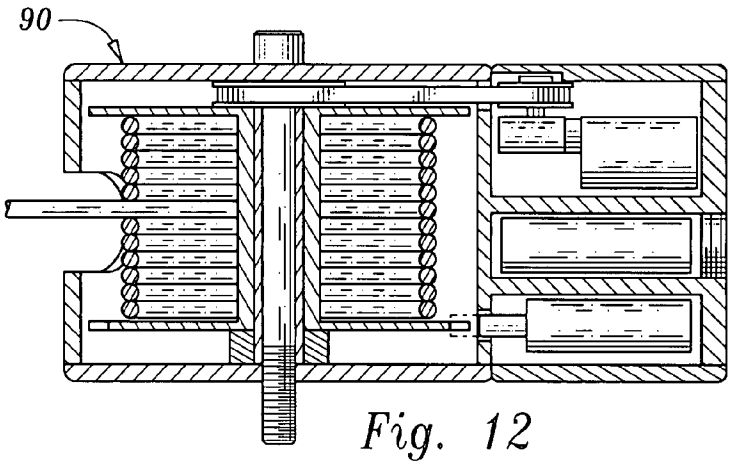
FIG. 12 is a view similar to FIG. 11, but showing a second alternative embodiment of the invention.
Figure 13:
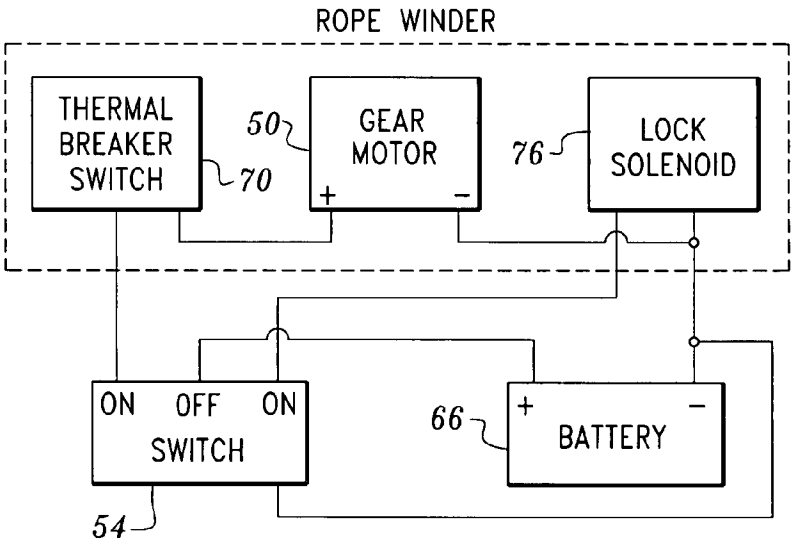
FIG. 13 is a schematic diagram illustrating the relationship between various components of the drive structure and shut-off structure of the apparatus.

In the FIG. 12 embodiment, identified by reference numeral 90, the gear motor, the thermal breaker switch and the solenoid are stacked one over the other, the primary axes of these components located in different horizontal planes.

The invention claimed is:

1. Apparatus for attachment to a boat to support and pull a tow rope, said apparatus comprising, in combination:

a support;

a tow rope spool having the tow rope connected thereto, said tow rope spool rotatably mounted on said support and selectively rotatable in either a winding direction to wind the tow rope thereabout or an unwinding direction to unwind the tow rope;

drive structure including an electric motor operatively associated with said spool selectively actuatable to rotate said spool in the winding direction to wind the tow rope about said spool; and automatic shut-off structure operatively associated with said drive structure to deactivate said drive structure to terminate rotation of said spool in said rewinding direction responsive to said tow rope attaining a predetermined condition, said predetermined condition being a magnitude of tension of said tow rope, and said automatic shut-off structure deactivating said drive structure after said tow rope reaches said magnitude of tension, said support including a housing having a housing interior accommodating said spool and defining a housing opening communicating with said housing interior, said tow rope extending through said housing opening and the tow rope having a distal end with a handle or other structural member thereon engageable with said housing when said tow rope is being rewound about said spool to tension said rope to said magnitude of tension.

2. Apparatus for attachment to a boat to support and pull a tow rope, said apparatus comprising, in combination:

support;

tow rope spool having the tow rope connected thereto, said tow rope spool rotatably mounted on said support and selectively rotatable in either a winding direction to wind the tow rope thereabout or an unwinding direction to unwind the tow rope;

drive structure including an electric motor operatively associated with said spool selectively actuatable to rotate said spool in the winding direction to wind the tow rope about said spool;

automatic shut-off structure operatively associated with said drive structure to deactivate said drive structure to terminate rotation of said spool in said rewinding direction responsive to said tow rope attaining a predetermined condition; and lock structure for selectively alternatively locking said spool against rotatable movement or unlocking said spool to allow rotation thereof by said drive structure.

3. The apparatus according to claim 2 wherein said lock structure includes a solenoid operated lock member movable between a first position wherein said spool is lockingly engaged by said solenoid operated lock member and a second position wherein said solenoid operated lock member is lockingly disengaged from said spool.

4. Apparatus for attachment to a boat to support and pull a tow rope, said apparatus comprising, in combination:

a support;

a tow rope spool having the tow rope connected thereto, said tow rope spool rotatably mounted on said support and selectively rotatable in either a winding direction to wind the tow rope thereabout or an unwinding direction to unwind the tow rope;

drive structure including an electric motor operatively associated with said spool selectively actuatable to rotate said spool in the winding direction to wind the tow rope about said spool; and automatic shut-off structure operatively associated with said drive structure to deactivate said drive structure to terminate rotation of said spool in said rewinding direction responsive to said tow rope attaining a predetermined condition, said predetermined condition being a magnitude of tension of said tow rope, said automatic shut-off structure deactivating said drive structure after said tow rope reaches said magnitude of tension, and said drive structure additionally including a spool pulley connected to said spool and a drive pulley rotated by said electric motor operatively associated with said spool pulley to rotate said spool pulley and spool upon rotation of said drive pulley by said electric motor.

5. The apparatus according to claim 4 wherein said drive structure additionally comprises a slip clutch.

6. The apparatus according to claim 5 wherein said automatic shut-off structure includes a thermal breaker switch for sensing heat developed in the apparatus during slippage of said slip clutch and for deenergizing said electric motor in response thereto to deactivate the drive structure.

7. The apparatus according to claim 4 wherein said drive structure additionally comprises a timing belt interconnecting said drive pulley and said spool pulley.

8. The apparatus according to claim 6 wherein said slip clutch operatively connects said drive pulley and said electric motor.

9. Apparatus for attachment to a boat to support and pull a tow rope, said apparatus comprising, in combination:

a support;

a tow rope spool having the tow rope connected thereto, said tow rope spool rotatably mounted on said support and selectively rotatable in either a winding direction to wind the tow rope thereabout or an unwinding direction to unwind the tow rope;

drive structure including an electric motor operatively associated with said spool selectively actuatable to rotate said spool in the winding direction to wind the tow rope about said spool;

automatic shut-off structure operatively associated with said drive structure to deactivate said drive structure to terminate rotation of said spool in said rewinding direction responsive to said tow rope attaining a predetermined condition, said support including a housing accommodating said spool and a shaft extending through said housing and through said spool releasably connectable to the boat to maintain said housing in fixed position on the boat, said spool being rotatable about said shaft; and a flashing light adjacent to said housing.

10. Apparatus for attachment to a boat to support and pull a tow rope, said apparatus comprising, in combination:

a support;

a tow rope spool having the tow rope connected thereto, said tow rope spool rotatably mounted on said support and selectively rotatable in either a winding direction to wind the tow rope thereabout or an unwinding direction to unwind the tow rope;

drive structure including an electric motor operatively associated with said spool selectively actuatable to rotate said spool in the winding direction to wind the tow rope about said spool; and automatic shut-off structure operatively associated with said drive structure to deactivate said drive structure to terminate rotation of said spool in said rewinding direction responsive to said tow rope attaining a predetermined condition, said support including a housing accommodating said spool and a shaft extending through said housing and through said spool releasably connectable to the boat to maintain said housing in fixed position on the boat, said spool being rotatable about said shaft and said shaft having a threaded lower end projecting from the bottom of said housing for threaded engagement with the boat.

11. Apparatus for attachment to a boat to support and pull a tow rope, said apparatus comprising, in combination:

a support;

a tow rope spool having the tow rope connected thereto, said tow rope spool rotatably mounted on said support and selectively rotatable in either a winding direction to wind the tow rope thereabout or an unwinding direction to unwind the tow rope;

drive structure including an electric motor operatively associated with said spool selectively actuatable to rotate said spool in the winding direction to wind the tow rope about said spool; and automatic shut-off structure operatively associated with said drive structure to deactivate said drive structure to terminate rotation of said spool in said rewinding direction responsive to said tow rope attaining a predetermined condition, said support including a housing accommodating said spool and a shaft extending through said housing and through said spool releasably connectable to the boat to maintain said housing in fixed position on the boat, said spool being rotatable about said shaft, said housing defining a housing interior and a housing opening communicating with said interior, said tow rope extending through said housing opening, said housing opening being elongated in a horizontal direction, allowing sideways movement of said tow rope during towing.

12. Apparatus for attachment to a boat to support and pull a tow rope, said apparatus comprising, in combination:

a support;

a tow rope spool having the tow rope connected thereto, said tow rope spool rotatably mounted on said support and selectively rotatable in either a winding direction to wind the tow rope thereabout or an unwinding direction to unwind the tow rope;

drive structure including an electric motor operatively associated with said spool selectively actuatable to rotate said spool in the winding direction to wind the tow rope about said spool; and automatic shut-off structure operatively associated with said drive structure to deactivate said drive structure to terminate rotation of said spool in said rewinding direction responsive to said tow rope attaining a predetermined condition, said support including a housing accommodating said spool and a shaft extending through said housing and through said spool releasably connectable to the boat to maintain said housing in fixed position on the boat, said spool being rotatable about said shaft, said support defining receptacles adjacent to said towing housing interior for receiving one or more components of said drive structure and said automatic shut-off structure.

* * * * *